US007603938B2

(12) United States Patent
Metcalfe

(10) Patent No.: US 7,603,938 B2
(45) Date of Patent: Oct. 20, 2009

(54) METHOD AND APPARATUS FOR FLUID REMOVAL FROM A CONTAINER

(75) Inventor: David A. Metcalfe, Dewinton (CA)

(73) Assignee: Explosives Limited, Calgary (CA)

( * ) Notice: Subject to any disclaimer, the term of this patent is extended or adjusted under 35 U.S.C. 154(b) by 15 days.

(21) Appl. No.: 11/551,604

(22) Filed: Oct. 20, 2006

(65) Prior Publication Data

US 2007/0101855 A1 May 10, 2007

(30) Foreign Application Priority Data

Oct. 21, 2005 (CA) ..... 2524101

(51) Int. Cl.
*F42B 1/02* (2006.01)
*F42D 3/00* (2006.01)

(52) U.S. Cl. ..... 89/1.14; 102/310

(58) Field of Classification Search ..... 89/1.14; 102/308–310, 319–321.1
See application file for complete search history.

(56) References Cited

U.S. PATENT DOCUMENTS 3,244,100 A * 4/1966 Bell ..... 102/310
4,160,412 A * 7/1979 Snyer et al. ..... 102/307
4,418,622 A * 12/1983 Foster et al. ..... 102/307
4,519,313 A * 5/1985 Leidel ..... 102/310
4,905,601 A * 3/1990 Gabriel et al. ..... 102/307
5,010,823 A * 4/1991 Morrison ..... 102/307
5,701,964 A * 12/1997 Walker et al. ..... 175/4.6
6,702,039 B2 * 3/2004 Parrott et al. ..... 175/4.6
2005/0150781 A1 * 7/2005 Barton et al. ..... 206/3

OTHER PUBLICATIONS

William H. Snyer, Use of linear shaped charge for cutting emergency vent and drain openings in a rail car, 2000, p. 1-13, Denver, CO, USA.
Lim, Seokbin, et al., Mechanisms of Linear Shaped Charge Cutting—A New Explanation, Thirty-First Annual Conference on Explosives and Blasting Technique, 2005, International Society of Explosives Engineers.
Shaped Charge—Wikipedia, the free encyclopedia, http://en.wikipedia.org/wiki/Shaped_charge.
Accurate Energetic Systems, LLC Shaped Charges.

* cited by examiner

*Primary Examiner*—Bret Hayes
(74) *Attorney, Agent, or Firm*—Dennis R. Haszko; Eaton Peabody Patent Group, LLC

(57) ABSTRACT

A method and apparatus for removing fluid from a container using a conventional shaped charge such as those used in well perforation; the charge being spaced from the container wall, and producing an explosive jet, the explosive jet directed by a diffuser disk to provide a vent or drain.

42 Claims, 3 Drawing Sheets

METHOD AND APPARATUS FOR FLUID REMOVAL FROM A CONTAINER

FIELD OF THE INVENTION

The present invention relates generally to a method and apparatus for removal of fluid from a container.

BACKGROUND OF THE INVENTION

When a pressurized storage or transport vessel, such as a highway tanker truck or a rail car containing a compressed, liquefied, flammable gas such as propane, is involved in a motor vehicle or other accident, a situation can arise where the fluid cannot be safely removed from the tanker or rail car by conventional methods such as bleeding off or pumping off the fluid using the tank openings and valves used for their removal in normal operations.

In these scenarios, an emergency venting of the fluid and ignition of the fluid is sometimes deemed to be the safest option. One method involves the attachment of variable amounts of C4 plastic or other explosives to the wall of the tanker and detonating the explosives to create a large hole in the tanker wall, thus allowing the fluid to be vented and burned off. This may result in an unpredictable or uncontrolled vent and burn situation.

It is, therefore, desirable to provide an improved method and apparatus for dealing with this emergency situation or other similar situation where fluid must be removed from a container.

SUMMARY OF THE INVENTION

It is an object of the present invention to obviate or mitigate at least one disadvantage of previous methods and apparatus for removing a product from a container.

In a first aspect, the present invention provides a charge assembly for removing a fluid from a container, the charge assembly having a shaped charge, the shaped charge adapted to be initiated by a user, a stand-off spacer adapted to receive the shaped charge and position the shaped charge at a distance from the container, the stand-off spacer having a spacer bore adapted to allow passage of an explosive jet from the shaped charge to the container upon initiation of the shaped charge, and a retainer attached to the spacer and having attachment means for attaching the retainer and the container, the attachment means having a retainer bore adapted to allow passage of the explosive jet from the shaped charge to the container upon initiation of the shaped charge.

Preferably, the charge assembly further includes a diffuser disk locatable against the container in the retainer bore. The diffuser disk is preferably adapted to have a thickness approximately equal to a wall thickness of the container. The diffuser disk preferably is generally cylindrical.

Preferably, the attachment means comprises a magnet, epoxy, putty, or adhesive. Preferably, the stand-off space has a tubular configuration. Preferably, the shaped charge is a conical type shaped charge. Preferably the shaped charge is a "big hole" type conical shaped charge conventionally used in perforating guns. Preferably, the shaped charge contains RDX (an explosive nitroamine also known as Cyclotrimethylenetrinitramine, cyclonite, or hexogen. Preferably, the shaped charge carries an explosive load in the range of about 10 to about 39 grams. More preferably, the charge assembly carries an explosive load of about 32 grams. Preferably, the stand-off spacer distance is about 1" (25 mm) to about 4" (100 mm).

In a further aspect, the present invention provides a charge assembly for removing a fluid from a container with a shaped charge, the charge assembly having a diffuser disk locatable against the container, a stand-off spacer adapted to receive the shaped charge and position the shaped charge at a distance from the container wall, the stand-off spacer having a central spacer bore, a retainer attached to the stand-off spacer and having a ring magnet adapted to attach to the container's wall for attaching the charge assembly to the container, the ring magnet having a central retainer bore, wherein the charge assembly is adapted to allow passage of an explosive jet from the shaped charge to the container upon initiation of the shaped charge to perforate the container by penetration of the container by the explosive jet.

In a further aspect, the present invention provides a method of removing a fluid from a container with a shaped charge, the container having an upper portion and a lower portion, the method having the steps of positioning a lower shaped charge proximate the container, initiating the lower shaped charge to produce an explosive jet, the explosive jet directed toward the container, wherein the container is perforated to form a lower hole in the lower portion of the container, and allowing the fluid to flow from the container through the lower hole.

Preferably, the method further includes the steps of positioning an upper shaped charge proximate the container, initiating the upper shaped charge to produce an explosive jet, the explosive jet directed toward the container, wherein the container is perforated to form an upper hole in the upper portion of the container, and allowing the fluid to flow from the container through the upper hole.

Preferably, the method further includes the step of diffusing the explosive jet before it strikes the container. Preferably, a plurality of upper shaped charges are activated to create a plurality of upper holes in the upper portion of the container. Preferably, a plurality of lower shaped charges are activated to create a plurality of lower holes in the lower portion of the container. Preferably, the method further includes the step of igniting the fluid escaping the upper hole. Preferably, the method further includes the step of igniting the fluid escaping the lower hole. Preferably, the method further includes the step of collecting at least a portion of the escaping fluid. Preferably, the method further includes the step of igniting the collected fluid. As used herein, fluid refers to a liquid, vapour, 2-phase, etc. and/or mixes thereof, as known to one ordinarily skilled in the art.

Preferably, the lower shape charge is initiated a wait time period after the upper shape charge. Preferably, the container is at a container pressure, the wait time period corresponding generally to a time period for the container pressure to drop to between about 25 psi (173 kPa) and about 125 psi (863 kPa). Preferably, the wait time period corresponding generally to a time period for the container pressure to drop to about 75 psi (518 kPa).

Preferably, the container is a pressurized or non-pressurized transport vessel. Preferably, the container is a portable storage tank, rail tank, or road tanker.

In a further aspect, the present invention provides a charge assembly for removing a fluid from a container, the charge assembly having a conical shaped "perforating gun" type charge, the charge adapted to be initiated by a detonating cord, a tubular stand-off spacer adapted to receive the charge and hold the charge a designed distance from the container wall, the stand-off spacer having a central bore adapted to allow passage of an explosive jet from the charge to the container wall upon activation of the charge and having a retainer with a ring magnet to attach the assembled charge and spacer to the container wall for attaching the charge assembly to the container, the ring magnet having a central bore with a diffuser disk within the bore to tailor the jet's shape and effect.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Figure 1:
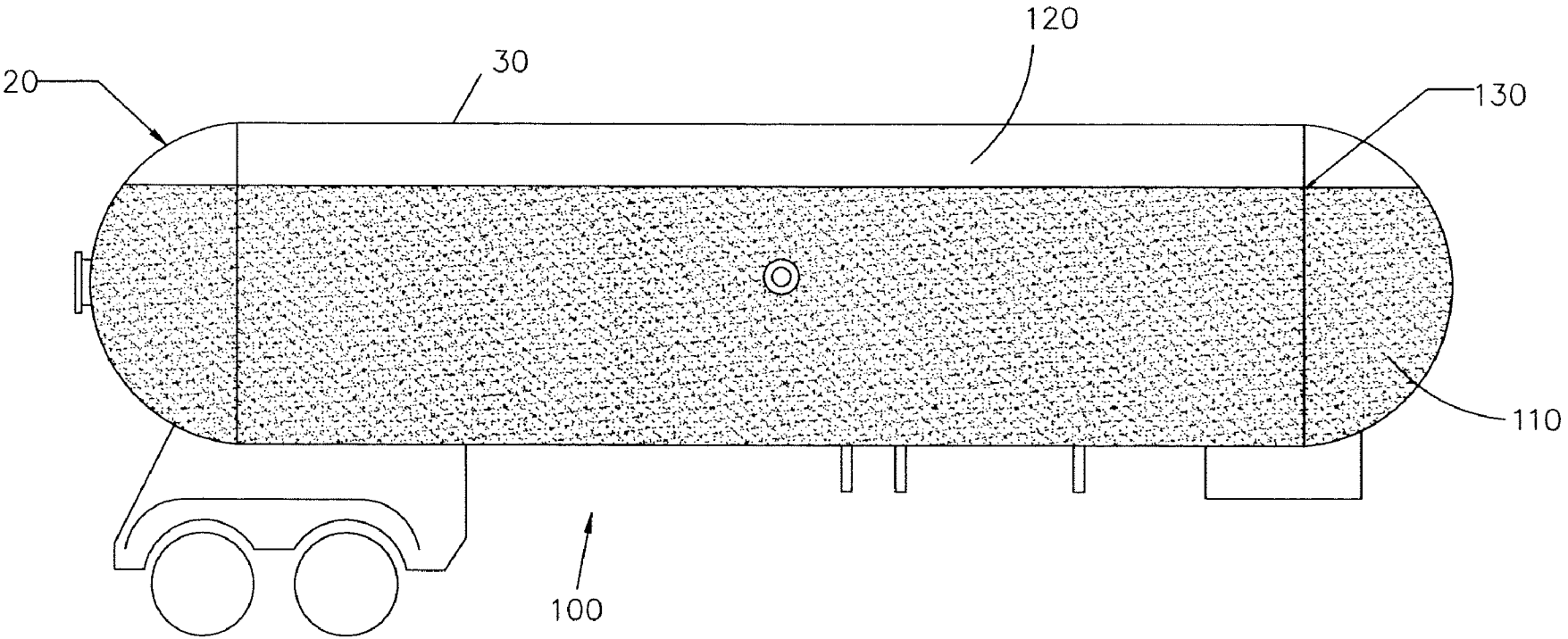
FIG. 1 is a tanker car carrying a product in a normal orientation.
Figure 2:
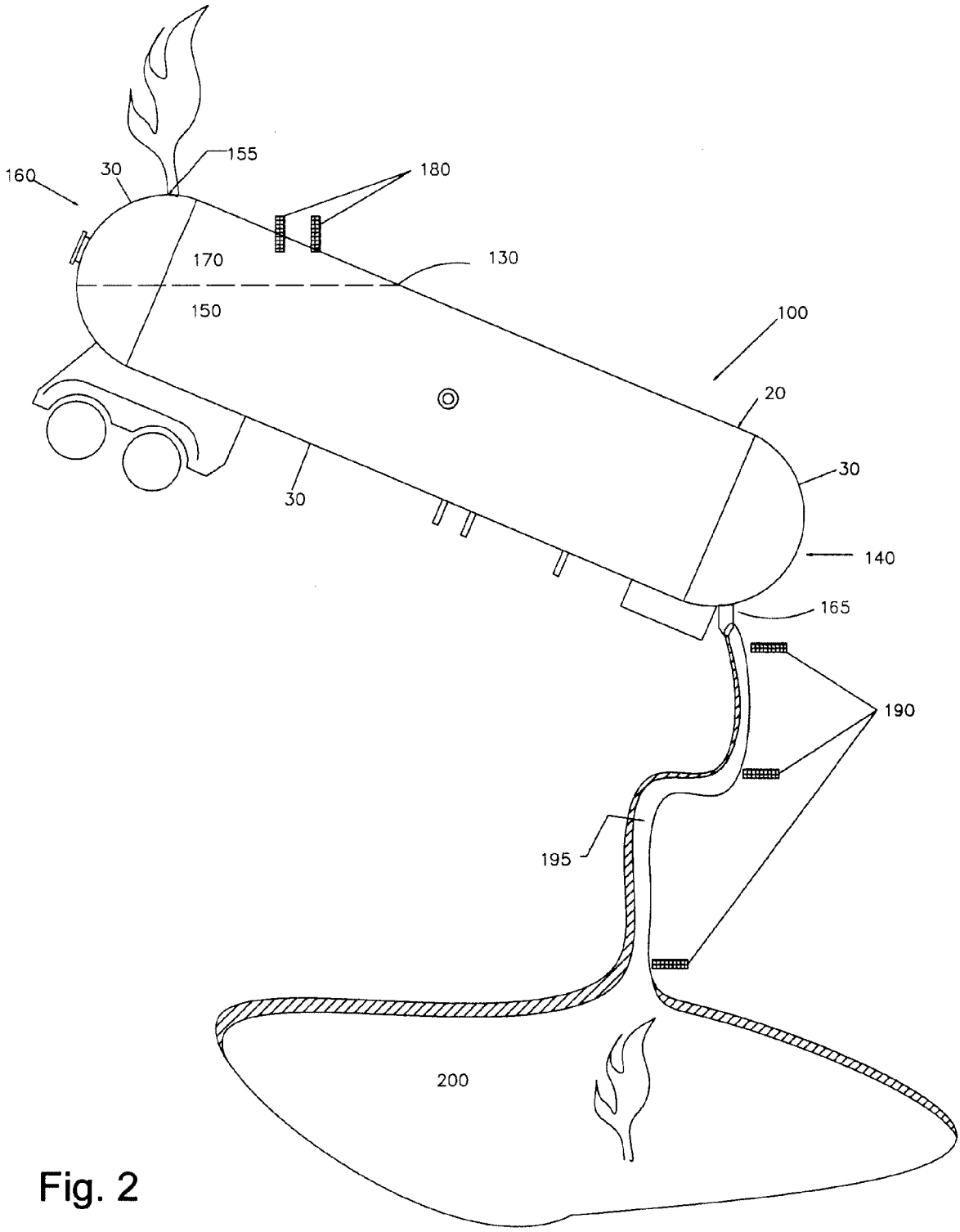
FIG. 2 is the tanker car in an emergency orientation.
Figure 3:
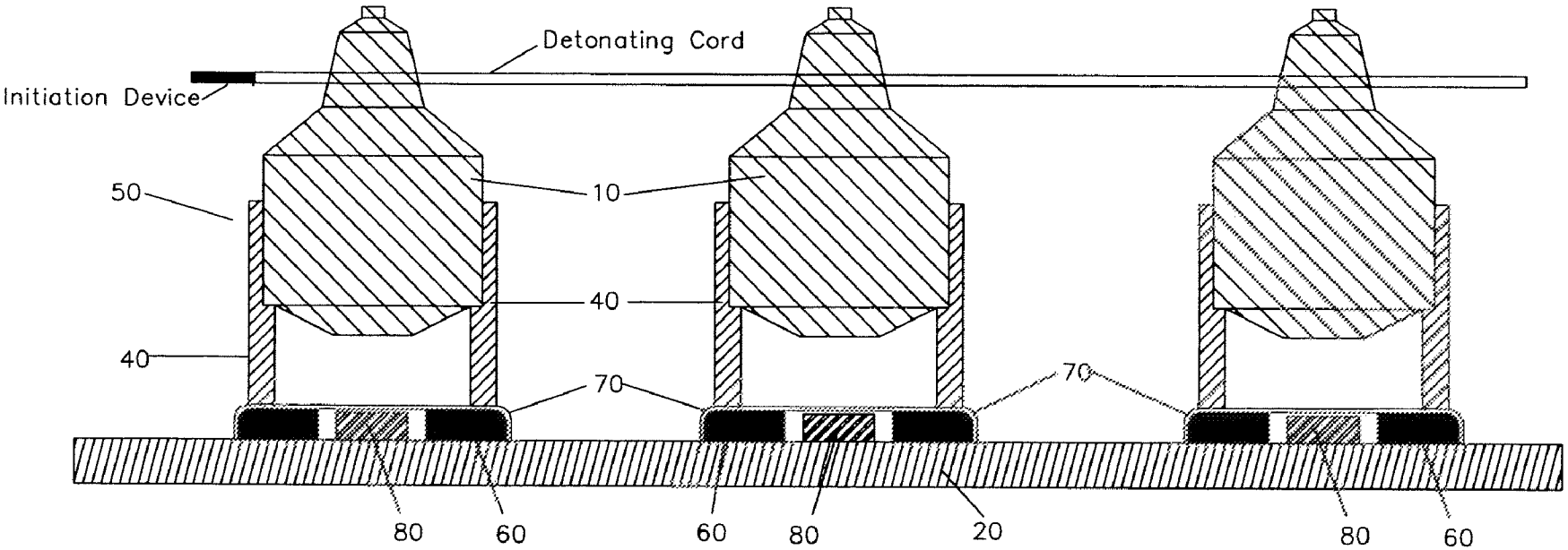
FIG. 3 is a detail of a charge assembly (lower or upper—showing three linked charge assemblies).

Referring generally to FIGS. 1, 2, and 3, the present invention provides a method and apparatus for removing a fluid from a tank.

Referring to FIG. 3, a charge assembly 50 of the present invention includes a conical shaped charge 10 is adapted to be spaced at a pre-determined distance from a wall 30 of a tank 20 by a stand-off spacer 40 (together the stand-off spacer 40 and the conical shaped charge 10 form the charge assembly 50) and an attachment mechanism for attaching the charge assembly 50 to the wall 30 of the tank 20.

The conical shaped charge 10 may be an oil well perforating gun-type conical shaped charge, preferably a "big-hole" type with a parabolic lining, the conical shaped charge 10 containing any variety of explosives, such as RDX, and an explosive load in the preferred range of about 10 to about 39 grams. Preferably, a 32 gram charge of the big-hole configuration has provided improved results on a road tanker configuration.

The stand-off spacer 40 may be constructed of a hollow tube type material such as plastic, metal or cardboard, and provides a certain degree of stand-off spacing between the conical shaped charge 10 and the wall 30 of the tank 20 to allow an explosive jet to properly form from the conical shaped charge 10, upon activation of the conical shaped charge 10. The stand-off spacer 40 preferably varies from about 1" (25 mm) - to about 4" (100 mm) depending on the shaped charge configuration used and the configuration of the target construction (e.g. the wall 30 of the tank 20).

The attachment mechanism may be a magnet 60, epoxy, putty, or other means for attaching the charge assembly 50 to the wall 30 of the tank 20. The attachment mechanism may comprise a retainer 70 having the magnet 60 and a central disk-shaped diffuser 80. The diffuser 80 provides improved performance of the explosive jet. A pre-determined number of charge assemblies may be linked together using detonating cord and may be initiated using techniques known in the art, including the use of electric or non-electric detonators.

In operation, for example used on a highway tanker 80% full of propane (Referring to FIG. 1), a tanker 100 has a tank 20 with a wall 30. In a normal orientation, the propane is generally transported in a 2-phase state, having a liquid space 110 and a vapour space 120.

Referring generally to FIG. 2, a tanker 100 may be at any given position, angle, or orientation, such as an emergency position, with the tank 20 being filled to a fill line 130 with a lower portion 140 filled with a liquid forming a liquid space 150 and an upper portion 160 filled with a vapour (for example propane vapour or air) forming a vapour space 170.

At least one (preferably at least three) upper holes 155 are perforated in the upper portion 160 of the wall 30 of the tank 20 using an upper charge assembly placed adjacent to the vapour space 170 of the tanker 100 and at least one (preferably at least three) of lower holes 165 are perforated in the lower portion 140 through the wall 30 of the tank 20 using a similarly deployed lower charge assembly. Upon detonation of the charge assemblies, explosive jets perforate the wall 30 of the tank 20 creating upper holes 155 and/or lower holes 165, thus allowing the fluid contained by the tank 20 to escape.

The respective charge assemblies 50 may be spaced apart to avoid interference with other charge assemblies 50 when each shaped charge 10 is detonated, preferably such as a spacing of about 3" (75 mm). Preferably, a plurality of upper holes 155 and a plurality of lower holes 165 are created.

As fluid flows out of the upper hole 155 (or holes), it may have already been ignited by the activation of the upper charge assembly 50 (or assemblies), but if not, at least one (preferably several) pyrotechnic-style flare or other ignition source 180 may be initiated (preferably down-wind) to ignite the escaping fluid (often vapour) from the upper hole 155. Similarly, the fluid (often liquid) flowing from the lower hole 165 may be ignited by activation of the lower charge assembly 50 or may be ignited by secondary ignition source 190 such as a pyrotechnic flare placed along the expected flow path.

Preferably, the fluid flowing from the lower hole 165 is directed away from the tanker 100 using directing means 195 such as a ditch or trench (run off trench) dug into the earth thus forming a pool (liquid burn pit) 200 adjacent to, but away from the tanker 100.

Preferably, the upper hole 155 allows the pressure of the fluid to drop before the lower hole 165 is created. The pressure may be allowed to drop to a pre-determined pressure (such as to between about 25 psi (172 kPa) and about 125 psi (861 kPa), but preferably about 75 psi (517 kPa), and/or there may be a pre-determined time delay between firing the upper and lower charge assemblies. Alternatively, the upper charge assembly 50 and lower charge assembly 50 may be fired substantially simultaneously or the lower charge assembly 50 may be fired before the upper charge assembly 50.

The combination of the upper hole 155 and lower hole 165 allows the tanker 100 to be vented and the fluid burnt off in a controlled manner in a reasonable time. The vent (upper hole 155) from the vapour space 170 along with the drain (lower hole 165) from the liquid space 150 to a pool fire adjacent the tanker act to reduce tanker pressure and minimize and control the fire impacted area without contributing to catastrophic tanker failure.

While particularly useful for tanker trucks containing the fluid propane, the method and apparatus of the present invention is also useful for other pressurized or non-pressurized storage or transport vessels such as portable storage tanks, rail tank cars, pressurized shipping containers, etc. While particularly useful for propane, the method and apparatus of the present invention is also useful for any flammable fluid (but is particularly useful for those flammable fluids that are vapours at ambient conditions but are transported in a pressurized, liquefied, or two-phase form, such as those known as liquefied petroleum gases (LPG) including methane, ethane, butane, propane, pentane, hexane etc., as well as other hydrocarbons or even non-hydrocarbons such as acetylene, hydrogen etc. as well as any liquid or vapour or any fluid that is transported in tanks.

The method and apparatus are also useful for non-flammable or inert fluids that must simply be drained but not burnt off, for example water, nitrogen, or liquefied oxygen.

In the preceding description, for purposes of explanation, numerous details are set forth in order to provide a thorough understanding of the embodiments of the invention. However, it will be apparent to one skilled in the art that these specific details are not required in order to practice the invention.

The above-described embodiments of the present invention are intended to be examples only. Alterations, modifications and variations may be effected to the particular embodiments by those of skill in the art without departing from the scope of the invention, which is defined solely by the claims appended hereto.

What is claimed is:

1. A charge assembly for removing a fluid from a container, the charge assembly comprising:

(a) a conical shaped charge, the conical shaped charge configured to pierce the container at a point location with an explosive jet and to be initiated by a user;

(b) a stand-off spacer configured to receive the conical shaped charge and position the shaped charge at a distance from the container, the stand-off spacer having a spacer bore configured to allow passage of the explosive jet from the conical shaped charge to the container upon initiation of the conical shaped charge; and (c) a retainer attached to the spacer and having attachment means for attaching the retainer and the container, the attachment means having a retainer bore configured to allow passage of the explosive jet from the conical shaped charge to the container upon initiation of the conical shaped charge.

2. The charge assembly of claim 1, further comprising a diffuser disk locatable against the container in the retainer bore.

3. The charge assembly of claim 2, the diffuser disk configured to have a thickness approximately equal to a wall thickness of the container.

4. The charge assembly of claim 2, the diffuser disk being generally cylindrical.

5. The charge assembly of claim 1, the attachment means comprising a magnet, epoxy, putty, or adhesive.

6. The charge assembly of claim 1, the stand-off spacer having a tubular configuration.

7. The charge assembly of claim 1, the conical shaped charge being a conical shaped charge with a hyperbolic lining ordinarily used in a perforating gun.

8. The charge assembly of claim 1, the conical shaped charge containing RDX.

9. The charge assembly of claim 1 where the container is pierced with a hole less than 2.0" in diameter.

10. The charge assembly of claim 1 where the container is pierced with a hole less than 1.0" in diameter.

11. A charge assembly for removing a fluid from a container with a conical shaped charge for providing an explosive jet to a point located on the container, the charge assembly comprising:

(a) a diffuser disk locatable against the container;

(b) a stand-off spacer configured to receive the conical shaped charge and position the conical shaped charge at a distance from the container wall, the stand-off spacer having a central spacer bore;

(c) a retainer attached to the stand-off spacer and having a ring magnet configured to attach to the container's wall for attaching the charge assembly to the container, the ring magnet having a central retainer bore, wherein the charge assembly is configured to allow passage of an explosive jet from the conical shaped charge to the container upon initiation of the conical shaped charge to perforate the container by penetration of the container by the explosive jet at the point.

12. The charge assembly of claim 11 where the perforation for which it is designed is less than 2.0" in diameter.

13. The charge assembly of claim 11 where the perforation for which it is designed is less than 1.0" in diameter.

14. A method of removing a fluid from a container with a conical shaped charge configured to pierce the container at a point on the container with an explosive jet, the container having an upper portion and a lower portion, the method comprising the steps of:

(a) positioning a lower such conical shaped charge proximate the container;

(b) initiating the lower such conical shaped charge to produce an explosive jet, the explosive jet directed toward a point on the container, wherein the container is perforated to form a small lower hole in the lower portion of the container with a perforation sized to provide controlled evacuation of fluid from the container; and (c) allowing the fluid to flow from the container in a controlled way through the small lower hole.

15. The method of claim 14, the method further comprising the steps of:

(a) positioning an upper such conical shaped charge proximate the container;

(b) initiating the upper conical shaped charge to produce an explosive jet, the explosive jet directed toward the container, wherein the container is perforated to form a small upper hole in the upper portion of the container with a perforation sized to provide controlled evacuation of fluid from the container; and (c) allowing the fluid to flow from the container in a controlled way through the small upper hole.

16. The method of claim 15, wherein a plurality of conical upper shaped charges are activated to create a plurality of small upper holes in the upper portion of the container.

17. The method of claim 15, further comprising the step of igniting the fluid escaping the small upper hole.

18. The method of claim 15 where the small hole is less than 2.0" in diameter.

19. The method of claim 15 where the small hole is less than 1.0" in diameter.

20. The method of claim 14, further comprising the step of diffusing the explosive jet before it strikes the container.

21. The method of claim 14, wherein a plurality of lower conical shaped charges are activated to create a plurality of small lower holes in the lower portion of the container.

22. The method of claim 14, further comprising the step of igniting the fluid escaping the small lower hole.

23. The method of claim 14, further comprising the step of collecting at least a portion of the escaping fluid.

24. The method of claim 23, further comprising the step of igniting the collected fluid.

25. The method of claim 14, wherein the lower conical shaped charge is initiated a wait time period after the upper conical shaped charge.

26. The method of claim 25, wherein the container is at a container pressure, the wait time period corresponding generally to a time period for the container pressure to drop to between about 25 psi (173 kPa) and about 125 psi (863 kPa).

27. The method of claim 25, the wait time period corresponding generally to a time period for the container pressure to drop to about 75 psi (518 kPa).

28. The method of claim 14, wherein the container is a pressurized or non-pressurized transport vessel.

29. The method of claim 14, wherein the container is a portable storage tank, rail tank, or road tanker.

30. The method of claim 14 where the small hole is less than 2.0" in diameter.

31. The method of claim 14 where the small hole is less than 1.0" in diameter.

32. A charge assembly for removing a fluid from a container, the charge assembly comprising:

(a) a conical shaped charge configured to pierce the container at a point on the container with an explosive jet, the shaped charge configured to pierce the container and to be initiated by a user;

(b) a stand-off spacer configured to receive the shaped charge and position the shaped charge at a distance from the container, the stand-off spacer having a spacer bore configured to allow passage of an explosive jet from the shaped charge to the container upon initiation of the shaped charge; and (c) a retainer attached to the spacer and having attachment means for attaching the retainer and the container, the attachment means having a retainer bore configured to allow passage of the explosive jet from the shaped charge to the container upon initiation of the shaped charge; and (d) further comprising a diffuser disk locatable against the container in the retainer bore.

33. The charge assembly of claim 32, the diffuser disk configured to have a thickness approximately equal to a wall thickness of the container.

34. The charge assembly of claim 32, the diffuser disk being generally cylindrical.

35. The charge assembly of claim 32 where the conical shaped charge is configured to pierce a hole less than 2.0" in diameter.

36. The charge assembly of claim 32 where the conical shaped charge is configured to pierce a hole less than 1.0" in diameter.

37. A method of removing a fluid from a container with a conical shaped charge configured to pierce the container at a point on the container with an explosive jet, the container having an upper portion and a lower portion, the method comprising the steps of:

(a) positioning a lower shaped charge proximate the container;

(b) initiating the lower shaped charge to produce an explosive jet, the explosive jet directed toward the container, wherein the container is perforated to form a lower hole in the lower portion of the container;

(c) allowing the fluid to flow from the container through the lower hole; and (d) further comprising the step of diffusing the explosive jet before it strikes the container.

38. The charge assembly of claim 37 where the conical shaped charge is configured to pierce the container leaving a hole less than 2.0" in diameter.

39. The charge assembly of claim 37 where the conical shaped charge is configured to pierce the container leaving a hole less than 1.0" in diameter.

40. A method of removing a fluid from a container with a conical shaped charge configured to pierce the container at a point on the container with an explosive jet, the container having an upper portion and a lower portion, the method comprising the steps of:

(a) positioning an upper shaped charge design proximate the container;

(b) initiating the upper shaped charge to produce an explosive jet, the explosive jet directed toward the container, wherein the container is perforated to form an upper hole in the upper portion of the container;

(c) allowing the fluid to flow from the container through the lower hole; and (d) further comprising the step of diffusing the explosive jet before it strikes the container.

41. The charge assembly of claim 40 where the conical shaped charge is configured to pierce the container leaving a hole less than 2.0" in diameter.

42. The charge assembly of claim 40 where the conical shaped charge is configured to pierce the container leaving a hole less than 1.0" in diameter.

* * * * *